United States Patent [19]

Mantel

[11] 4,429,610

[45] Feb. 7, 1984

[54] SHELL RELOADER

[76] Inventor: Robert W. Mantel, N80 W23090 Plainview Rd., Sussex, Wis. 53089

[21] Appl. No.: 327,775

[22] Filed: Dec. 7, 1981

[51] Int. Cl.[3] ..... F42B 33/12

[52] U.S. Cl. ..... 86/36; 86/23; 86/26; 86/45

[58] Field of Search ..... 86/23, 25, 26, 27, 36, 86/45, 37; 221/105

[56] References Cited

U.S. PATENT DOCUMENTS

| | | | |
|---|---|---|---|
| 4,027,781 | 6/1977 | Covert | 86/37 X |
| 4,228,724 | 10/1980 | Leich | 86/23 X |
| 4,331,063 | 5/1982 | Schaenzer | 86/26 X |

FOREIGN PATENT DOCUMENTS

| | | | |
|---|---|---|---|
| 766494 | 9/1967 | Canada | 86/27 |

*Primary Examiner*—Leland A. Sebastian
*Attorney, Agent, or Firm*—Ronald E. Barry

[57] ABSTRACT

An automatic shell reloader of the type having a fixed platen and a die platen, the die platen having a plurality of dies for performing the reload function and being moveable toward and away from the fixed platen to reload a shell case, the improvements comprising a guard carried by a primer cap slide assembly mounted on the fixed platen to block the force of a detonated primer cap from reaching the die platen, and a primer cap storage assembly mounted on the die platen, the storage assembly including a storage tube having a number of spring biased fingers at the lower end for retaining primer caps in the tube and a cam mounted on the fixed platen in a position to engage the fingers to release one primer cap at a time from the tube.

8 Claims, 5 Drawing Figures

SHELL RELOADER

BACKGROUND OF THE INVENTION

Shell reloaders of the type contemplated herein are used to recondition and reload used shell casings. The operation is completely automatic in that the used casings are moved through four operating stations on a fixed platen in a step by step manner in sequence to the operation of a die platen. The first station sizes the opening in the casing and decaps the case; the second station primes, expands and bells the case mouth, charges the case with powder and seats a primer cap in the casing; the third station seats the bullet in the top of the case; and the fourth crimps the case to the bullet. In some instances the bullet can be seated and the case crimped at the same time.

The primer caps are normally stored in a tube mounted on the front of the slide platen of the reloader. The caps are dropped into a hole in a primer slide either by gravity or by a force produced by the weight of a pin placed on the top of the primer caps. In rare instances, the primer cap that is being seated in the opening in the shell case explodes with sufficient force to explode all of the primer caps remaining in the storage tube. This explosive force is sufficient to cause physical damage if the operator is in close proximity to the reloader at the time of the explosion.

SUMMARY OF THE INVENTION

The present invention is primarily concerned with the provision of a guard on the primer slide assembly that minimizes the force of an exploding primer cap; thus increasing the safety of the reloader for the operator. This has been accomplished by mounting the storage tube for the primer caps on the die or moveable platen rather than the fixed platen. The storage tube is moved away from the fixed platen, at the time that the primer cap is seated in the shell casing. The guard member is mounted on the primer cap slide and is moved with the slide to a position to overly the primer cap reservoir in the fixed platen when a cap is seated in the casing. Since the storage tube for the primer caps is moved away from the fixed platen any explosive force produced in the fixed platen on detonation of a primer cap will be confined to the reservoir in the fixed platen. The storage tube is provided with a unique retaining system for holding the primer caps in the tube when the die platen is lifted off the fixed platen. A primer tube stud is provided on the fixed platen in a position to open the end of the storage tube to release a primer cap from the storage tube so that it is free to fall into the reservoir in the fixed platen during each cycle of the die platen.

IN THE DRAWINGS

DETAILED DESCRIPTION OF THE INVENTION

Figure 1:
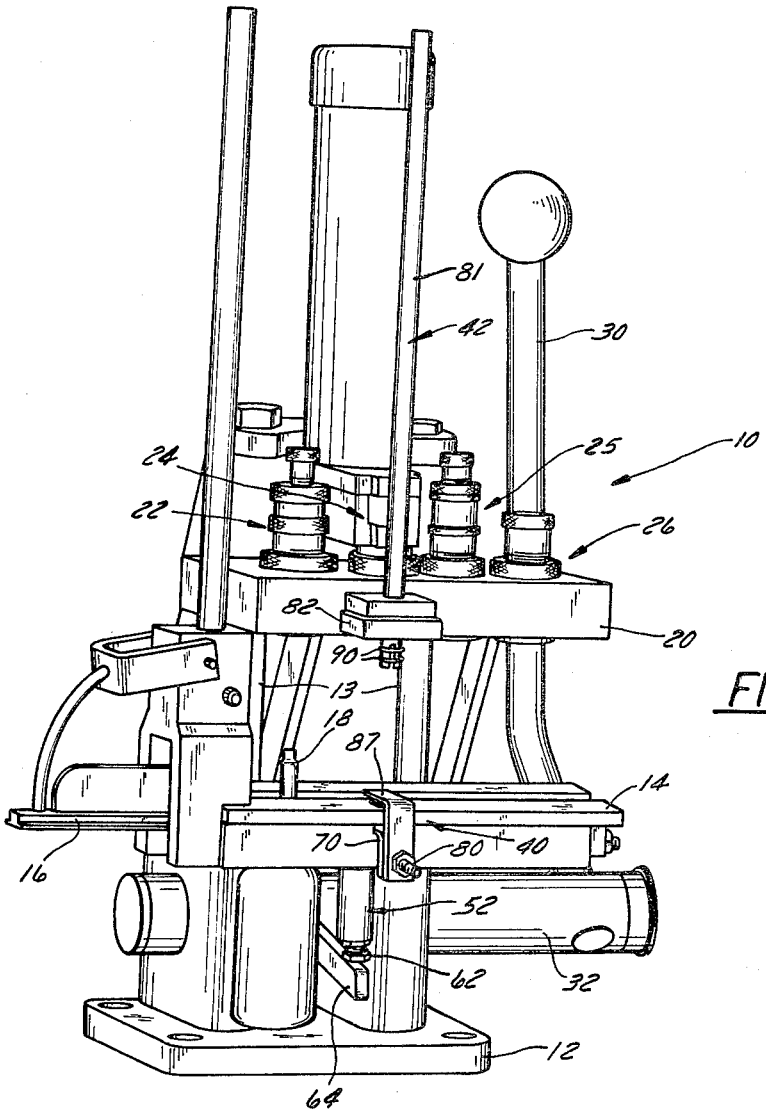
FIG. 1 is a front perspective view of a shell reloader showing the primer cap slide assembly on the fixed platen and the storage tube assembly mounted on the die platen.

A shell reloader 10 of the type contemplated herein is substantially similar to a Auto Champion Mark IV type reloader made by C-H Tool and Die Corporation of Owen, Wis. As seen in FIG. 1, the reloader 10 includes a base 12 supporting a lower or fixed platen 14. A slide 16 is provided in the fixed platen for moving shell casings 18 in a step-by-step manner across the top of the platen. A moveable or die platen 20 is supported on the base by means of a pair of columns 13. The die platen 20 is moved toward and away from the fixed platen in sequence with the movement of the casings across the fixed platen.

The die platen 20 includes four operating dies for performing the reloading functions as the shell case is moved from left to right across the fixed platen. The first station includes a decaping die 22 for removing the primer cap from the used casing. The second station includes an expansion die 24 to bell the case mouth and charge the case with powder. The third station includes a seating die 25 for seating a bullet in the mouth of the casing. The fourth station includes a crimping die 26 to crimp or roll the casing around the bullet.

The die platen 20 is moved through a cycle of operation by means of a handle 30 mounted on an actuating rod 32. The handle is pulled down by hand to bring the dies on the die platen in contact with the shell casings on the fixed platen. On return motion of the handle, the casings are advanced on to the next station. During the final return movement of the handle a primer cap 44 is seated in the shell casing located at the second station. The mechanical operation of the reloader is fully disclosed in the operating manuals of the above described reloaders.

A primer cap slide assembly 40 is mounted on the front of the fixed platen 14 and a primer cap storage assembly 42 is mounted on the die platen 20. The slide assembly 40 transports the primer caps 44 between a storage reservoir 43 and an opening 50 provided in the fixed platen beneath the shell casing 18. The primer cap storage assembly 42 stores primer caps on the die platen 20 and releases a primer cap 44 to the reservoir 43 on each cycle of motion of the die platen.

In this regard and referring to FIG. 2 through 5, cross-section views are shown of the slide assembly 40 and storage assembly 42 at the second station on the reloader. A shell casing 18 is shown in the slide 16 above the opening 50 in the fixed platen. The primer cap 44 shown in opening 50 is seated in the casing 18 by means of a primer post mechanism 52 mounted on the fixed platen beneath the opening 50. The primer post mechanism 52 includes a housing 54 having a primer pin 56 positioned in the housing for movement through the opening 50. The primer pin 56 is biased by a spring 58 to a neutral position within the housing. The primer pin 56 is moved upward to seat the primer cap 44 in the casing 18 by means of a primer post 62 which depends from the lower end of the primer post housing. The primer post is pushed upward by a lever 64 operatively connected to the rod 32.

Primer caps 44 are moved from the primer cap reservoir 43 in the fixed platen to a position beneath the casing 18 by means of the primer slide assembly 40. In this regard, the assembly 40 includes a primer cap slide member 70 having an opening 72. The slide member 70 is connected to an operating rod 73 by a screw 75 and is biased by means of a spring 74 to a first or starting position wherein the opening 72 is in alignment with the primer pin 56 and the opening 50 in the fixed platen. The location of the opening 72 with respect to the opening 50 must be accurate and is adjusted by means of an adjustment screw 80 provided on the end of the primer slide member 70.

Figure 4:
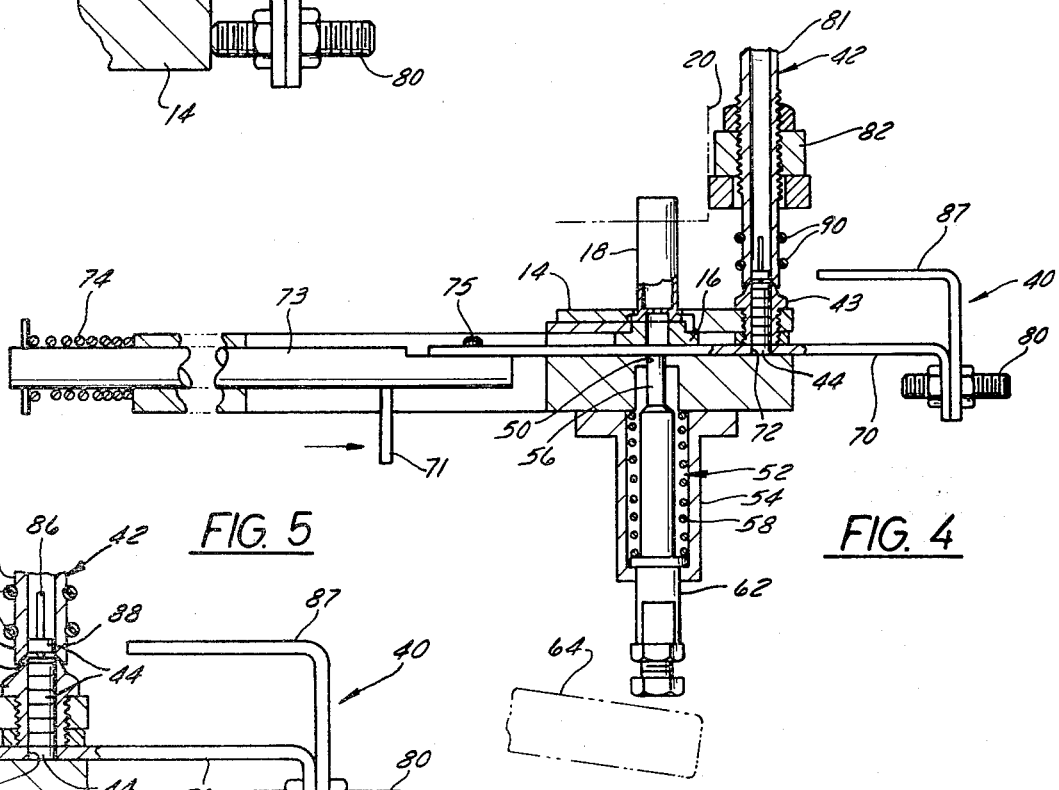
FIG. 4 is a side elevation view similar to FIG. 2 showing the slide assembly in position to receive a primer cap from the reservoir.
Figure 5:
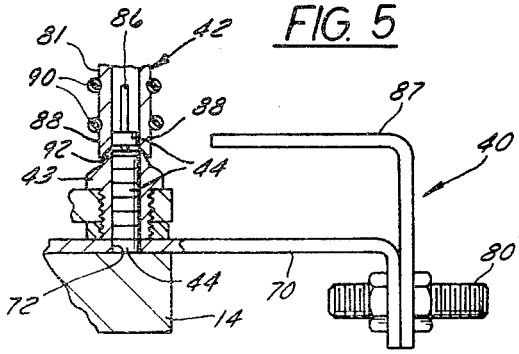
FIG. 5 is an enlarged view of a portion of the primer cap slide assembly shown in FIG. 4 showing the guard moved away from the space between the storage tube and reservoir.

The primer slide member 70 is moved to a second or load position, as seen in FIG. 4, to pick up a primer cap 44 from the primer cap reservoir 43 on the downward motion of the die platen by the engagement of a pin 71 to rod 73 with the rod 32. On the upward movement of the die platen, the primer slide member 70 is moved to the first position by the spring 74 to carry a primer cap 44 under the casing 18.

Primer caps 44 are stored in the primer cap storage assembly 42 which is mounted on the front of the die platen 20. The storage assembly includes a tube 81 supported by means of a bracket 82 on the front of the platen 20. The primer caps 44 are retained within the tube 81 by a catch means provided at the lower end of the tube 81. In this regard, the catch means is formed by cutting four slots 86 in the lower end of the tube 81 to define four fingers or sections 88. The fingers 88 are biased inwardly by means of a pair of O-rings 90 wrapped around the outer surface of the tube 81. The O-rings will bias the four fingers or sections 88 of the tube inwardly to hold the bottom primer cap in the tube.

The bottom primer cap 44 is released from the tube 81 on the downward motion of the die platen 20 by the engagement of the catch means with a hollow cam release stud 92 provided at the entrance to the primer cap storage reservoir 43 with the lower end of tube 81. The stud 92 engages the fingers 88 and forces them outward against the bias of the O-rings. The bottom primer cap will then drop on the top of the primer caps in the reservoir 43. On upward movement of the die platen, the lower end of the storage tube will move away from the cam release stud 92 allowing the O-rings to bias the fingers 88 of the tube into engagement with the primer cap 44 at the bottom of the tubes.

Figure 2:
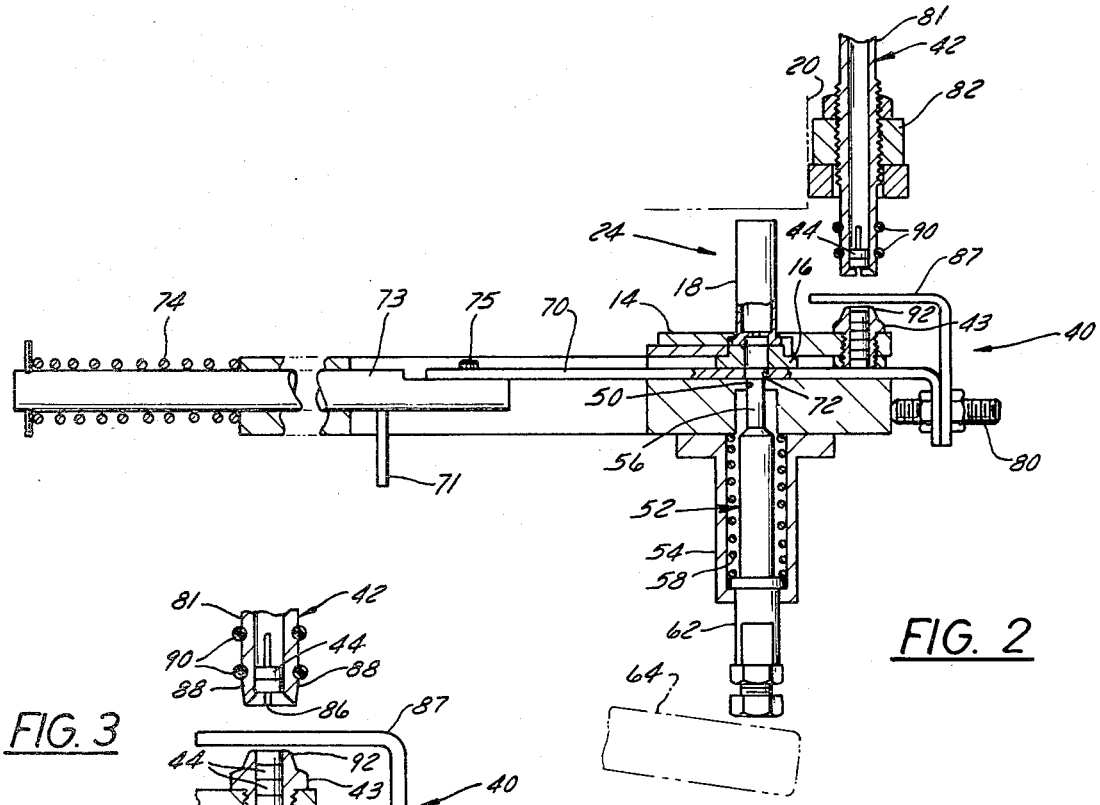
FIG. 2 is a side elevation view of the primer cap slide assembly in position to seat a primer cap in a shell case.
Figure 3:
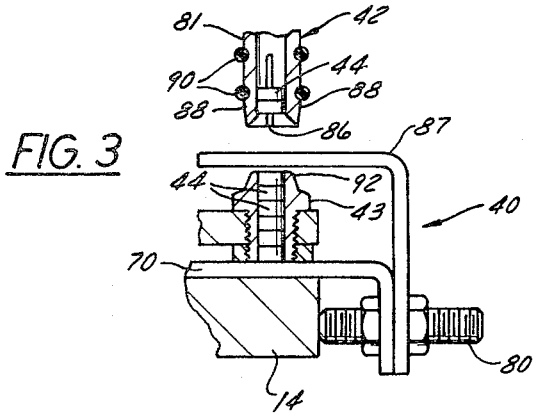
FIG. 3 is an enlarged view of a portion of the primer cap slide assembly shown in FIG. 2 with the guard shown in the blocking or safe position.

The opening over the primer tube reservoir 43 is covered or closed by means of a flat guard or finger 87 provided on the slide member 70. The guard 87 moves into the space between the tube 81 and reservoir 43 as the primer slide moves into the slide platen, as seen in FIGS. 2 and 3. In the event of detonation of a primer cap 44 by the primer pin 56, the explosive force will be transferred to the primer cap storage reservoir 43 and could detonate the primer caps 44 stored in the reservoir. However, any explosive force created on detonation of the caps in the reservoir will be blocked from tube 81 by means of the guard 87 preventing detonation of the caps in the tube 81.

I claim:

1. In an automatic shell reloader of the type having a fixed platen and a movable die platen with a slide in the fixed platen to move used shell casings in a step-by-step manner to a number of dies on the die platen; the improvement comprising a primer cap storage reservoir on the fixed platen, a primer cap slide assembly mounted for reciprocal motion on the fixed platen, and a primer cap storage assembly mounted on said die platen above said reservoir, said primer cap slide assembly being positioned to move the bottom primer cap in said reservoir to an opening in the fixed platen below a shell casing on the fixed platen, said primer cap storage assembly including a storage tube and means at the lower end of said storage tube for retaining primer caps in the tube, means mounted on said storage reservoir in a position to release said retaining means on the end of the storage tube and allow the bottom primer cap in the tube to drop into the reservior when the die platen is moved toward the fixed platen, and guard means on said primer cap slide assembly to block the space above the reservoir when said slide assembly is moved into the platen.

2. In an automatic shell reloader of the type having a fixed platen and a die platen movable toward and away from the fixed platen, the improvement comprising a primary cap reservoir in the fixed platen, a primer cap storage assembly mounted on the die platen above said reservoir, and a primer cap slide assembly mounted on said fixed platen in a position to move the bottom primary cap in the reservoir to an opening in the fixed platen, said slide assembly including guard means movable with said slide assembly to a position above the reservoir to protect said storage assembly from explosions occurring in said reservoir.

3. A reloader according to claim 2 wherein said storage assembly includes a storage tube having a latch means at the lower end for engaging the primer cap at the bottom of the storage tube, and a cam means on said reservoir for releasing the latch means when the die platen is moved to a work position over the fixed platen whereby the bottom primer cap in the tube is free to drop into the reservoir.

4. In a shell reloader having a fixed platen and a die platen movable toward and away from the fixed platen, a primer cap storage reservoir in said fixed platen, a primer cap slide assembly mounted on said fixed platen for moving a primer cap from said storage reservoir to a position to be seated in a shell casing, and guard means on said slide assembly for closing the reservoir to confine any explosion of the primer caps in the reservoir.

5. The reloader according to claim 4 including a primer cap storage assembly on said die platen for storing primer caps above said reservoir.

6. The reloader according to claim 5 wherein said storage assembly means includes a storage tube having a plurality of fingers at the lower end, and a resilient ring mounted on the fingers to bias the fingers into engagement with the primer cap at the bottom of the tube.

7. In an automatic shell case reloader of the type having a die platen moveable toward and away from a fixed platen, the improvement comprising a primer cap slide assembly mounted on the fixed platen, and a primer cap storage assembly mounted on the die platen, said slide assembly including a guard means moveable into the space between the die platen and fixed platen on seating a primer cap in a shell casing whereby detonation of the primer cap is confined to the fixed platen.

8. The reloader according to claim 7 wherein said storage assembly includes a storage tube having a latch means for retaining primer caps in said tube, and said fixed platen includes a primer cap storage reservoir and a cam means mounted on the reservoir for releasing said latch means to allow a primer cap to drop into said reservoir when the die platen is moved toward the fixed position.

* * * * *